US006417445B1

(12) United States Patent
Sato et al.

(10) Patent No.: US 6,417,445 B1
(45) Date of Patent: Jul. 9, 2002

(54) ELEMENTARY COAXIAL CABLE WIRE, COAXIAL CABLE, AND COAXIAL CABLE BUNDLE

(75) Inventors: Kazuhiro Sato; Kiyonori Yokoi, both of Kanuma; Yukifumi Chiba, Osaka, all of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/611,953

(22) Filed: Jul. 6, 2000

(30) Foreign Application Priority Data

Jul. 6, 1999 (JP) ..... 11-191718

(51) Int. Cl.[7] ..... H01B 7/34
(52) U.S. Cl. ..... 174/36; 174/28
(58) Field of Search ..... 174/36, 110 R, 174/113 R, 106 R, 102 R, 102 C, 103 C, 28

(56) References Cited

U.S. PATENT DOCUMENTS 3,643,007 A * 2/1972 Roberts et al. ..... 174/106
4,579,420 A * 4/1986 Winter et al. ..... 350/96.23
4,719,320 A * 1/1988 Strait, Jr. ..... 174/106 R
4,761,519 A * 8/1988 Olson et al. ..... 174/107
5,146,048 A 9/1992 Yutori et al. ..... 174/36
5,180,884 A * 1/1993 Aldissi ..... 174/36
5,483,020 A * 1/1996 Hardie et al. ..... 174/36
5,554,236 A * 9/1996 Singles et al. ..... 156/52
5,574,260 A * 11/1996 Broomall et al. ..... 174/102 R

FOREIGN PATENT DOCUMENTS

EP 0 465 113 1/1992
GB 2 206 725 1/1989
JP 9-035541 A * 2/1997

OTHER PUBLICATIONS

C & M Corporation, Jan. 1992, Engineering Design Guide (3rd Edition), see pp. 1–2.*
Patent Abstracts of Japan for Publication No. 09035541 published Feb. 7, 1997.

* cited by examiner

*Primary Examiner*—Dean A. Reichard
*Assistant Examiner*—William H. Mayo, III
(74) *Attorney, Agent, or Firm*—Smith, Gambrell & Russell, LLP

(57) ABSTRACT

A cable wire having a core conductor 11, an insulator 12 surrounding the core conductor, and an outer conductor 13 surrounding the insulator 12 is provided. The core conductor 11 is made of a metallic material including copper and silver so as to have a tensile strength of 120 kg/mm$^2$ or more and an electric conductivity of 60 to 90% by IACS. The cable wire 1 is also employed in a coaxial cable 2 and a coaxial cable bundle.

7 Claims, 5 Drawing Sheets

ELEMENTARY COAXIAL CABLE WIRE, COAXIAL CABLE, AND COAXIAL CABLE BUNDLE

BACKGROUND OF THE INVENTION

1. Field of the Invention

The present invention relates to an elementary coaxial cable wire, and a coaxial cable and a coaxial cable bundle using the above elementary coaxial cable wire.

2. Description of Related Art

It is known that wire cables used for signal transmission in medical equipment such as a diagnostic probe in a ultrasonic diagnostic apparatus, and an endoscope, as well as in an industrial robot; and wire cables used for internal connection in information equipment such as a notebook-sized personal computer are repeatedly bent during use. This causes strain to be accumulated in the wire cable and there is a possibility that a break in the wire cable may occur.

Accordingly, in order to increase bending resistance of the wire cable, a stranded wire formed by twisting a number of thin wires together is broadly employed as the core conductor of a coaxial cable (or an elementary coaxial cable wire thereof), i.e., as the wire cable. One example of such a coaxial cable is shown in Japanese Laid-Open Patent Publication No. 9-35541, in which a wire made of conductive fiber reinforced copper matrix complex and a cable formed by this wire are disclosed.

SUMMARY OF THE INVENTION

The inventors in the present application have applied themselves closely to the study of the above prior art wire and cable using such a wire. As a result, they have found that the prior art involves the following drawbacks, that is:

(1) Although the prior coaxial cable using a stranded wire as a core conductor thereof has good flexibility, the configuration of the stranded wire formed by twisting thin wires together may collapse or loosen when crimped or pressed. Thus, a break in the core conductor may occur when the coaxial cable is in service;

(2) When the end of the core conductor is soldered to a circuit board having a pattern of fine-pitch traces, short circuits may be possibly caused, as the thin wires come undone due to the loosening of the stranded wire. Thus, the connection and successive processing of the coaxial cable end, including inspection of manufactured coaxial cables, become very complicated; and (3) Furthermore, the stranded wire not only involves the above disadvantages, but also requires much expense in time and effort to manufacture the same. Thus, it has been desired to provide a coaxial cable not only having good flexibility, but also capable of decreasing manufacturing and connecting costs.

The present invention has been made in view of the above circumstances and has for its object to provide an elementary coaxial cable wire, a coaxial cable, and a coaxial cable bundle, each of which has a sufficient bending resistance, can effectively prevent a break or a short circuit in the connection, and can achieve greater economy.

The inventors have repeated diligent studies and, as a result, have found that there is a close correlation between a tensile strength and material of a core conductor, and a bending resistance of a wire. The present invention has been invented based on the above finding.

According to one aspect of the invention, an elementary coaxial cable wire comprising a core conductor, an insulator surrounding the core conductor, and an outer conductor surrounding the insulator is provided. The elementary coaxial cable wire is characterized in that the core conductor is made of a metallic material including copper and silver so as to have a tensile strength of 120 kgf/mm$^2$ (kg/mm$^2$) or more and an electrical conductivity of 60 to 90% by IACS (International Annealed Copper Standard).

Although a high bending resistance is required to elementary coaxial cable wires and coaxial cables used for the above-described applications, the prior art solid single wire consisting of the copper-containing metallic material could not exhibit the required bending resistance, resulting in a relatively short bending life (the number of bending times until fracture may be small). However, it has been determined that the elementary coaxial cable wire being constructed as above-explained according to the present invention has a very extended life despite the solid single wire employed as the core conductor. Generally, the fatigue limit increases with the tensile strength and this is substantially applicable to the bending characteristics. The more the tensile strength increases, the more the bending characteristics become superior.

Preferably, the core conductor has a plastic elongation of L in %, which meets the requirements expressed by the following equation (1):

$$0.2\% \leqq L \leqq 2.0\% \quad (1)$$

Bending tests were conducted on coaxial cables using conductors as a core conductor having the same tensile strength of 120 kgf/mm$^2$ or more but different in plastic elongation. As a result, it has been shown that the coaxial cables using the core conductors, of which plastic elongation falls within the range expressed in the equation (1), have bending life longer than that of the coaxial cables using the core conductors, of which plastic elongation is below the lower limit in that range. Thus, in point of the bending characteristics, the coaxial cables according to the present invention are far superior to the prior art cable.

This tendency is more notable in the coaxial cable according to the present invention, in which the core conductor comprises the solid single wire, as compared to the prior coaxial cable including the core conductor composed of the stranded wire. It is considered that in the bending tests, a strain larger than plastic elongation is created in the surface of a core conductor and with the specific configuration of a coaxial cable, plastic elongation of the core conductor according to the present invention becomes larger than the prior art. Therefore, it is expected that under the above conditions, the occurrence of a crack and the propagation thereof in a surface portion of the core conductor which is subject to the largest strain is more restricted in the core conductor forming the elementary coaxial cable wire according to the present invention.

It is also noted that as the core conductor is composed of a solid single wire, the configuration of the core conductor will not be easily collapsed when it is forcedly pressed at connectorizing process. Thus, a break in the core conductor is prevented from occurring when the elementary coaxial cable wire is in service. Furthermore, when the core conductor is soldered to a circuit board having a pattern of fine-pitch traces, the core conductor does not become loose, so that occurrence of short circuits can be effectively prevented. Thus, not only the load of inspection during the connection is significantly lightened, but also the number of man-hours needed to perform the connection and successive processing for the elementary coaxial cable wire can be surprisingly diminished.

Furthermore, as the core conductor is a solid single wire, the core conductor can be deformed so as to have a uniform cross section when the terminal end of the elementary coaxial cable wire is swaged by a press and so on, provided that pressure conditions and so on are maintained constant. Thus, it is possible to surely connect a plurality of elementary coaxial cable wires, as a single unit, to the corresponding connecting points on such as a substrate. In other words, the elementary coaxial cable wires can be easily connected, so to speak, in a manner similar to that in which an integrated circuit (IC) is deposited on such a substrate as a circuit board. As a result, the number of man-hours needed to perform the connection and successive processing of the elementary coaxial cable wires can be further surprisingly diminished.

As the conductivity is within the above range, it is possible to prevent increased transmission loss due to Joule heat created within the core conductor. Thus, as the increased loss of transmission due to Joule heat created within the core conductor during the signal transmission can be prevented, it is not necessary to increase the core-conductor diameter in order to restrict the loss of transmission.

Furthermore, conductivity and tensile strength are mutually contradictory. However, if the metallic material contains predetermined amounts of copper and silver, it is possible to provide the core conductor with the high conductivity and the high tensile strength, both being within the above ranges. The insulator may be preferably made of a flexible material so as to decrease the possibility that the insulator may break during the bending of the elementary coaxial cable wire.

Preferably, the metallic material has a silver percentage content of 2 to 10% in weight. By using the material having the preferable composition as above described, it becomes possible to enable the core conductor comprising the solid single wire to have surely the above values of tensile strength and conductivity. The core conductor may be manufactured in a manner similar to that conventionally used in forming of wires. It is thus possible to ensure that the bending characteristics of the elementary coaxial cable wire are surprisingly improved. In addition, the core conductor is not easily collapsed even if it is forcedly pressed and short circuits can be prevented. Thus, the number of man-hours needed to perform the connection and successive processing can be surprisingly lessened.

Further, the inventors in the present invention have applied themselves closely to the study of the mechanism of break in the core and outer conductors and found the conditions under which favorable bending characteristics can be obtained. That is, tensile strengths Tc and Tg of the core and outer conductors respectively preferably meet the requirements expressed by the following equation (2):

$$Tg \leqq Tc \leqq Tg \times 3 \quad (2)$$

If a value of Tc falls within the above range, it is possible to prevent the stress from being concentrated in the bend of either the core conductor or the outer conductor during the bending motion of the elementary coaxial cable wire. This means that a plastic deformation possibly occurring in one of the core and outer conductors does not increase over that occurring in the other. As a result, it is possible to prevent bending resistance of one of the core and outer conductors from being excessively decreased relative to that of the other.

Preferably, the core conductor has a diameter of 0.010 to 0.2 mm, more preferably 0.020 to 0.15 mm. Generally, bending tests are performed on mandrels (metallic bars or rods) having the same diameter, with the same load being applied thereon (refer to Methods of Flexural Testing, which will be explained below). In the bending tests, if the diameter is below 0.010 mm, bending life of the core conductor will be tend to decrease remarkably due to a stress applied on the core conductor. On the other hand, if the diameter exceeds 0.2 mm, a strain applied on the core conductor will be so large that the bending life is also reduced.

According to another aspect of the invention, a coaxial cable preferably comprises the aforementioned elementary coaxial cable wire, and a sheath surrounding the elementary coaxial cable wire. As stated above, the elementary coaxial cable wire according to the invention has the surprisingly increased bending resistance. If the sheath is flexible, the coaxial cable also has a sufficiently increased bending resistance. Furthermore, as the elementary coaxial cable wire can be very easily connected to connecting points on such as a circuit board, or a connector, the number of man-hours needed to perform the connection and successive processing can be surprisingly diminished.

Preferably, the coaxial cable according to the present invention comprises a plurality of elementary coaxial cable wires arranged in a row within the sheath. This enables the coaxial cable to have an increased bending resistance, especially when bent around an axis along the row of the elementary coaxial cable wires. The coaxial cable may be formed thinner than that possible in such an arrangement in which elementary coaxial cable wires are not disposed in a row. Thus, the coaxial cable may be laid in a narrow space within a device and so forth.

According to further aspect of the invention, a coaxial cable bundle is provided, which includes a plurality of coaxial cables according to the present invention, the coaxial cables being disposed within a sheath. With the multi-coaxial cable having the above configuration, because the sheath has the good flexibility, the bending resistance inherent in each coaxial cable can be maintained. This enables the coaxial cable bundle to have a bending resistance at least equal to or greater than the bending resistance of the coaxial cables.

Furthermore, as the terminal end of each elementary coaxial cable wire may be processed in a uniform configuration, the coaxial cable bundle can be surely and easily connected to connecting points on such as a circuit board, or a connector. In consequence, the number of man-hours needed to perform the connection and successive processing of the coaxial cable bundle can be lessened.

In the present invention, the terms "tensile strength" and "plastic elongation" are defined in JIS C 3002 and a value of "electrical conductivity" are determined in accordance with JIS C 3001.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
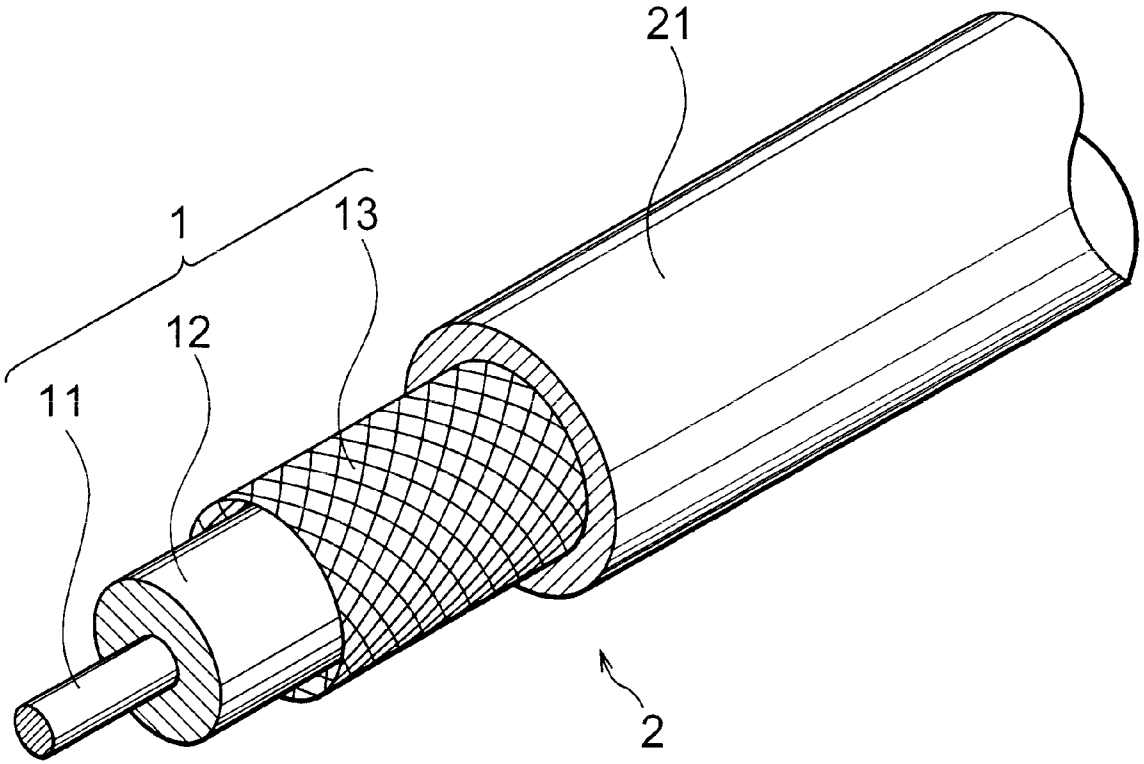
FIG. 1 is a fragmental perspective view of one embodiment of a coaxial cable according to the present invention.

The present invention will be explained in detail hereinafter in conjunction with the preferred embodiments of an elementary coaxial cable wire, a coaxial cable, and a coaxial cable bundle shown by way of example only in the accompany drawings, in which the same or similar members are labeled with the same reference numeral throughout the drawings in order to avoid redundancies.

Elementary Coaxial Cable Wire and Coaxial Cable

Figure 2:
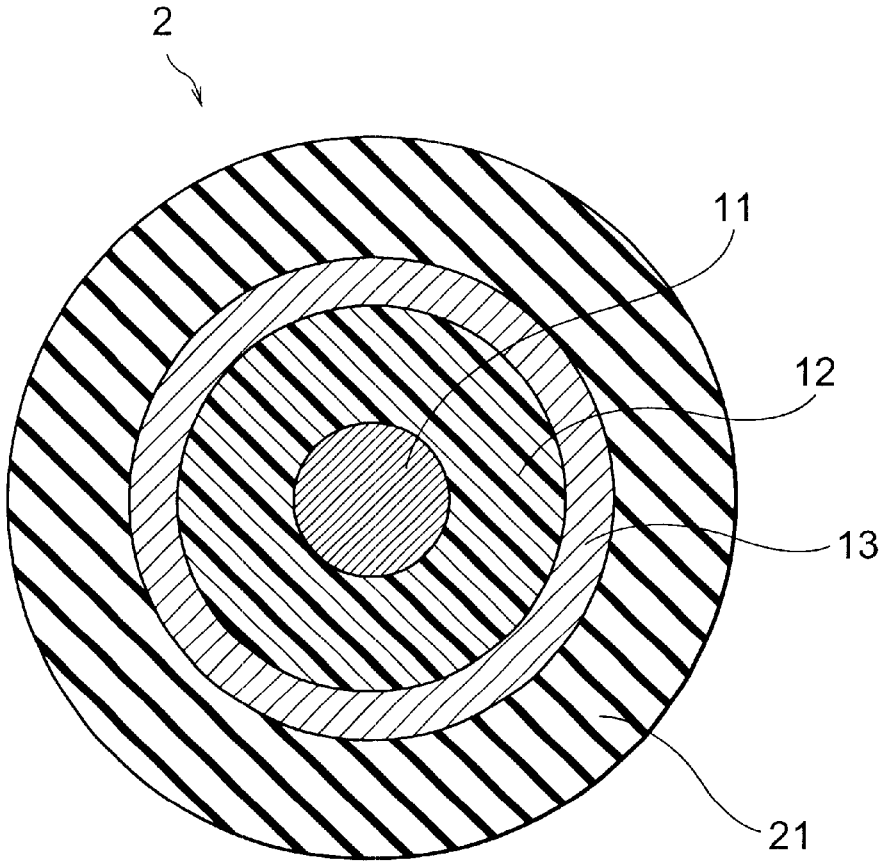
FIG. 2 shows a cross section of the coaxial cable of FIG. 1 in an enlarged scale.

FIG. 1 is a perspective view showing one example of a coaxial cable according to the present invention, and FIG. 2 is a cross section of the coaxial cable. As shown in these figures, the coaxial cable generally shown by a reference number 2 comprises a tubular sheath 21, and a cable wire 1 (an elementary cable wire) coaxially disposed in the sheath 21. The wire 1 comprises a core or center conductor 11 made of a solid metallic single wire, an insulator 12 surrounding the core conductor 11, and an outer conductor 13 surrounding the insulator 12. These elements 11 to 13 will be explained in detail below.

The core conductor 11 consists of a solid single wire made of a copper-based metallic material including silver. A percentage content of silver in the metallic material may be preferably 2 to 10% in weight, more preferably 2 to 6% in weight, and most preferably 3 to 5% in weight. The metallic material of such chemical composition has excellent electrical conductivity. With the material having the preferable composition as above described, it is possible to surely achieve tensile strength of 120 kgf/mm$^2$ (kg/mm$^2$) or more and an electrical conductivity of 60 to 90% prescribed by the IACS.

This metallic material may be produced by any suitable method. For example, predetermined amounts of copper and silver are melted and an ingot is molded from the molten copper and silver. The ingot is hot or cold worked into a linear workpiece, which is in turn further hot treated and cold worked until the core conductor 11 having tensile strength of 120 to 160 kgf/mm$^2$ can be obtained. However, the invention is not limited to the above method.

A conductivity of the core conductor 11 is prescribed within the range of 60 to 90% by IACS as in the aforesaid metallic material. If the conductivity is below 60% by IACS, increased Joule heat will be increased within the core conductor when the latter transmits a signal, resulting in increased loss of transmission. On the other hand, if the conductivity exceeds the upper limit, it will become necessary to change the composition of the metallic material, especially the percentage of silver content. This will make it difficult to maintain the tensile strength of the core conductor 11 within the aforementioned range.

Furthermore, it is noted as previously stated that conductivity and tensile strength are mutually contradictory. However, maintaining the composition of the metallic material within the aforesaid preferable range makes it possible to ensure that a core conductor having a high conductivity as well as high tensile strength is provided.

Preferably, a plastic elongation of the core conductor 11 meets the requirements expressed by the following equation:

$$0.2\% \leq L \leq 2.0\% \quad (1)$$

wherein L represents a plastic elongation in %.

Assuming that core materials have the same tensile strength, there is a tendency that a higher-plastic-elongation material will result in a higher-bending-resistance elementary axial cable wire and coaxial cable. Especially, in the case of the elementary axial cable wire 1 and the coaxial cable 2 having the core conductor 11 composed of a solid single wire, the above tendency is more notable as compared to a coaxial cable having a core conductor composed of stranded wires. It is expected that this is because most of bending tests are generally performed under such conditions that a strain of 0.2% or more is created in a core conductor and a solid single wire is more strained during bending tests as compared to the prior stranded wire.

Furthermore, an outer diameter of the core conductor 11 is preferably set to 0.010 to 0.2 mm, more preferably to 0.020 to 0.15 mm. If the diameter is below 0.010 mm, a stress applied on the core-conductor 11 will increase and therefore bending life of the cable wire 1 and the coaxial cable 2 will be tend to decrease. On the other hand, If the diameter exceeds 0.020 mm, a strain applied on the core-conductor 11 will be so large that the bending life is also reduced.

The insulator 12 is preferably composed of any flexible and insulative material. Such a material may include, for example, epoxy resins, polyester resins, polyurethane resins, polyvinyl alcohol resins, vinyl chloride resins, vinyl ester resins, acrylic resins, epoxy acrylate resins, diaryl phthalate resins, phenolic resins, polyamide resins, polyimide resins, melamine resins, organic fiber made from at least one resin selected from the preceding resins, and inorganic fiber made from any suitable inorganic substances. It is to be noted that any one of the above materials may be used by itself or in conjunction with at least one material selected from the remaining materials. However, the invention is not limited to the aforesaid materials and combination thereof.

More specifically, fluororesins such as polyethylene terephthalate may be favorably used for forming the insulator 12. The insulator 12 can be formed into a configuration shown in FIG. 1 in such a manner, for example, placing the core conductor 11 into a mold having a tubular hollow space and then extruding or injecting the aforesaid resin material around the core conductor 11.

A conductor suitably selected from flexible outer conductors (so called, shields) generally employed in commercial fine coaxial cables may be used as the outer conductor 13. Such an outer conductor 13 may be formed, for example, by spirally winding a thin and narrow conductor in the form of a tape or a fine wire around the insulator 12 coating the core conductor 11.

The outer conductor 13 may be formed by braiding thin wires or stranded extra-fine wires (e.g., Litz wire) along the periphery of the insulator 12 as shown in FIG. 1. It is to be noted that the wire 1 formed by providing the insulator 12 and the outer conductor 13 around the periphery of the core conductor 11 as shown in FIG. 1 is defined as an "elementary coaxial cable wire" in the present application.

Any one suitably selected from many sheaths generally employed in commercially available coaxial cables may be used as the sheath 21. For example, the sheath 21 may be formed by placing the cable wire 1 in thermoplastic resin selected from the aforesaid resins or in any other thermoplastic material, or wrapping the aforesaid thermoplastic resin or material around the cable wire 1 and then heating the combined cable wire 1 and aforesaid thermoplastic resin or material for deposition. Alternatively, the sheath 21 may be formed in a manner similar to that employed in the formation of the insulator 12, i.e., by extruding the aforesaid resin material around the cable wire 1.

It is possible to harden thermosetting materials in the form of a tubular member, in which the cable wire 1 may be inserted. Thus, the tubular member serves as the sheath 21. However, in the case where the cable wire 1 is of a relatively small diameter, the aforesaid manners using thermoplastic materials are preferable in view of easiness of the sheath formation.

Furthermore, in the cable wire 1, tensile strengths of the core and outer conductors 11 and 13 meet the requirements expressed by the following equation (2):

$$Tg \leqq Tc \leqq Tg \times 3 \quad (2)$$

wherein Tc represents a tensile strength of the core conductor 11 and Tg represents a tensile strength of the outer conductor 13.

If a value of Tc falls within the above range, it is possible to prevent the stress from being concentrated in the bend of either the core conductor 11 or the outer conductor 13 during the bending motion of the cable wire 1. This means that a plastic deformation possibly occurring in one of the core conductor 11 and the outer conductor 13 will not increase over that in the other. In other words, it is possible to prevent bending resistance of one of the core conductor 11 and the outer conductor 13 from being excessively decreased relative to that of the other, resulting in increased bending resistance of the cable wire 1.

According to the cable wire 1 as an elementary coaxial cable wire and the coaxial cable 2 manufactured in the above-discussed manner, the following effects can be exhibited. As the metallic material forming the core conductor 11 contains copper as the main ingredient as well as silver, different characteristic domains mainly containing copper and silver, respectively, may be formed during the casting. These domains each shows an extra-fine fibrous structure in the core conductor 11 manufactured from the metallic material in the above manner. As a result, the core conductor 11 advantageously increases in not only its mechanical strength, but also tensile strength. Thus, it is understood that the core conductor 11 having normally mutually contradictory high conductivity and high tensile strength can be obtained.

As the tensile strength of the core conductor 11 is thus adequately increased (i.e., the tensile strength falls within the above-discussed region), fatigue limit and bending properties thereof can be improved. Therefore, although the core conductor 11 consists of a solid single wire, the cable wire 1 and the coaxial cable 2 having satisfactory bending resistance can be provided.

If the percentage of silver content in the metallic material is maintained in the range of 2 to 10% in weight, it is assured that the core conductor 11 can exhibit high tensile rigidity and high electrical conductivity. This assures that the cable wire 1 and the coaxial cable 2 can exhibit well-increased bending resistance and conductivity.

Furthermore, as the conductivity of the core conductor 11 is adequately increased (i.e., the conductivity is fall within the above discussed region), it is possible to prevent increased transmission loss caused by increased Joule heat, which is created within the core conductor 11 during the signal transmission. Therefor, the cable wire 1 and the coaxial cable 2 having satisfactory transmission property can be provided.

In addition, as the increase in the transmission loss of signal can be prevented, there is no need to increase the diameter of the core conductor 11, which has been required to restrain such a transmission loss. Therefore, the cable wire 1 and the coaxial cable 2 can be made thinner, so that they can be conveniently installed in confined and narrow spaces within a device with higher density. In addition, the cable wire 1 and the coaxial cable 2 can be made more lightweights.

It is also noted that as the core conductor 11 is composed of a solid single wire, the core conductor 11 will not be easily deformed or collapsed even if it is forcedly pressed. Thus, a break in the core conductor 11 is prevented from occurring when the coaxial cable 2 and the cable wire 1 are in service.

Furthermore, when the core conductor 11 is soldered to a circuit board having a pattern of fine-pitch traces, no short circuits are caused at the soldered connection, because the core conductor 11 does not become loose. Thus, the number of man-hours needed to perform the connection and successive processing for the cable wire 1 or the coaxial cable 2 can be surprisingly diminished, resulting in improved economies of the connection and successive processing.

As the core conductor 11 is composed of a solid single wire, the core conductor 11 can be deformed so as to have a uniform cross section when the terminal of the cable wire 1 or the coaxial cable 2 is swaged, provided that pressure conditions and so on are maintained constant. Thus, it is possible to surely and easily connect a plurality of cable wires 1 and coaxial cables 2, in the block, to corresponding connecting points on such as a circuit board. As a result, the number of man-hours needed to perform the connection and successive processing for the cable wire 1 or the coaxial cable 2 can be further surprisingly diminished, resulting in more improved economies of the processing.

Furthermore, as the plastic elongation of the core conductor 11 preferably meets the requirements expressed by the above-discussed equation (1), it is possible to restrain a crack or cracks from occurring within the core conductor 11 and if occurred the propagation thereof can be prevented. Thus, this results in the increased bending resistances of the cable wire 1 and the coaxial cable 2.

Furthermore, when the outer diameter of the core conductor 11 is preferably set to 0.010 to 0.2 mm, more preferably to 0.020 to 0.15 mm, it is possible to prevent the stress and therefore strain on the core conductor 11 from being undesirably increased. Therefore, the bending lives of the cable wire 1 and the coaxial cable 2 can be further increased. Even if the tensile stress is routinely applied on the cable wire 1 and/or the coaxial cable 2, they can preferably withstand such a tensile stress, preventing the break in the cable wire 1 or the coaxial cable 2.

As the insulator 12 is made of the selected flexible material, the possibility that the insulator 12 is broken during the bending of the cable wire 1 may be minimized. Thus, the possibility of electrical continuity between the core conductor 11 and the outer conductor 13 may also be minimized and the improved electromagnetic shielding characteristics of either of the cable wire 1 and the coaxial cable 2 can be maintained, even when the bending is repeated. Furthermore, because the sheath 21 also has the flexibility, the increased bending resistance of the cable wire 1 can be maintained. This enables the coaxial cable 2 to have a sufficient bending resistance.

Figure 3:
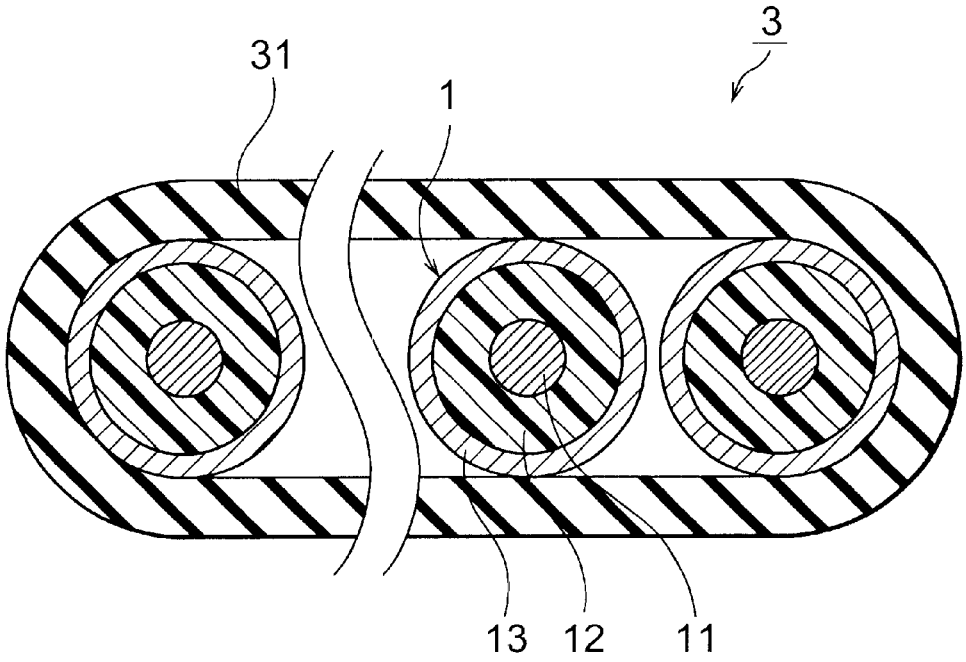
FIG. 3 is a view showing a cross section of a coaxial cable according to another embodiment of the present invention with a portion or portions thereof being removed.

Referring now to FIG. 3, there is shown a cross section of another embodiment of a coaxial cable according to the present invention. In FIG. 3, the coaxial flat cable 3 comprises a tubular flexible sheath 31, and a plurality of cable wires 1 disposed in a row within the sheath 31. The sheath 31 may be formed of such a material as suitably selected from those for forming the sheath 21. It is noted that the sheath 31 may be formed in a manner similar to that used in forming of the sheath 21, except that the single sheath 31 encircles the plural cable wires 1.

With the coaxial flat cable 3 having the above configuration, because the sheath 31 has the flexibility, the bending resistance and flexibility of each cable wire 1 can be maintained. This enables the coaxial flat cable 3 to have an increased bending resistance, especially when bent around an axis along the row of the cable wires 1. The coaxial flat cable 3 may be formed thinner than that possible in such an arrangement in which the cable wires 1 are not disposed in the row. Thus, the coaxial flat cable 3 may be laid in a narrow space within a device and so on.

In addition, as the terminal end of each cable wire 1 may be made in a uniform configuration, the coaxial flat cable 3 can be surely and easily connected to connecting points on such as a circuit board, or a connector. As a result, the number of man-hours needed to perform the connection and successive processing for the coaxial flat cable 3 can be further diminished.

Multi-Coaxial Cable

Figure 4:
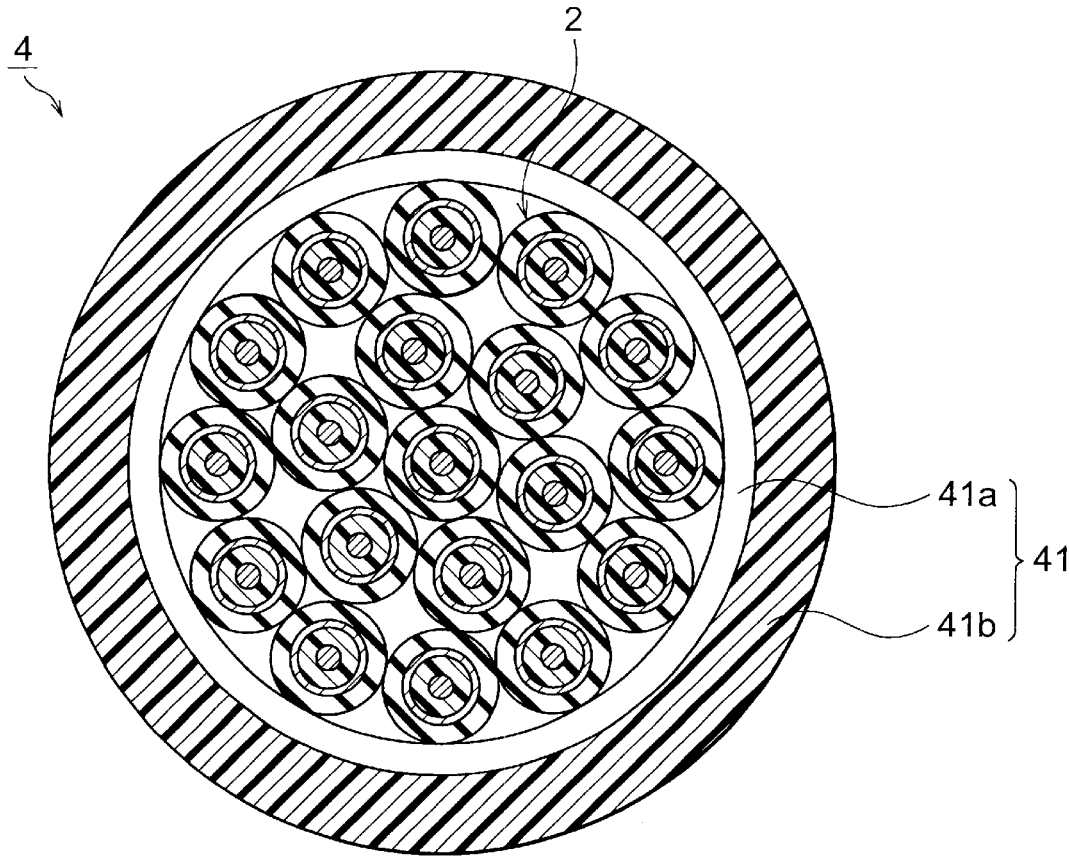
FIG. 4 is a cross section of a coaxial cable bundle according to further embodiment of the present invention.

FIG. 4 shows a cross section of a further embodiment of a coaxial cable bundle according to the present invention. The multi-coaxial cable 4 as a coaxial cable bundle comprises a flexible sheath 41 and a plurality of coaxial cables 2 densely disposed within the sheath 41. The sheath 41 comprises an inner tubular sheath 41*a* having electric shielding characteristics, and an outer tubular sheath 41*b* surrounding the inner sheath 41*a* outwardly, the outer sheath 41*b* being formed of a plastic material. It is noted that the inner sheath portion 41*a* may be formed in a manner similar to that forming the outer conductor 13 (see FIGS. 1 and 2) of the cable wire 1. On the other hand, the outer sheath 41*b* may be formed of such a material as that used to form the sheath 31 of the coaxial flat cable 3 (see FIG. 3) and in a manner similar to that forming the sheath 31.

With the multi-coaxial cable 4 having the above configuration, because the sheath 41 has the flexibility, the flexibility and bending resistance inherent in each coaxial cable 2 can be maintained. This enables the coaxial cable 4 to have a bending resistance at least equal to or larger than the bending resistance of the coaxial cables 2. Furthermore, as the terminal end of each cable wire 1 may be made in a uniform configuration, the multi-coaxial cable 4 can be surely and easily connected to connecting points. As a result, the number of man-hours needed to perform the connection and successive processing for the multi-coaxial cable 4 can also be diminished.

Preferably, each of the above-described cable wire 1, coaxial cables 2 and coaxial flat cable 3, and multi-coaxial cable 4 may be utilized as, for example, a cable connecting a diagnostic probe with a signal processor in a ultrasonic diagnostic probe; a cable connecting the imaging device of an endoscope with a signal processing part; a cable used in medical equipment to connect a sensor or probe with a signal processing part; a cable used in a flexion such as arm joints of an industrial robot; a cable used in a notebook-sized personal computer to connect a display part with a body thereof including memory, CPU, etc.; a cable connected to a portion subject to mechanical vibrations caused by a vibrator, a power equipment, etc.; and a cable connected to a portion subject to fluidic vibrations, such as an instrumentation sensor or probe attached within a fluid pipe.

It is understood that the peripheral surfaces of the core conductor 11 and the outer conductor 13 may be plated with a metal such as tin, silver, soft solder, etc. The sheath 41 forming a part of the multi-coaxial cable 4 may consist of only the outer sheath portion 41*b*. The insulator 12 may be formed of insulative organic and/or inorganic material attached or coated on the core conductor 11 by such as painting, flame spraying, or evaporating thereof.

EXAMPLES

In the following, the present invention is specifically explained with reference to Examples, which do not restrict the present invention as long as the latter does not deviate from the gist thereof. The examples are first explained with respect to "flexural testing methods".

Method of Flexural Testing 1

Figure 5:
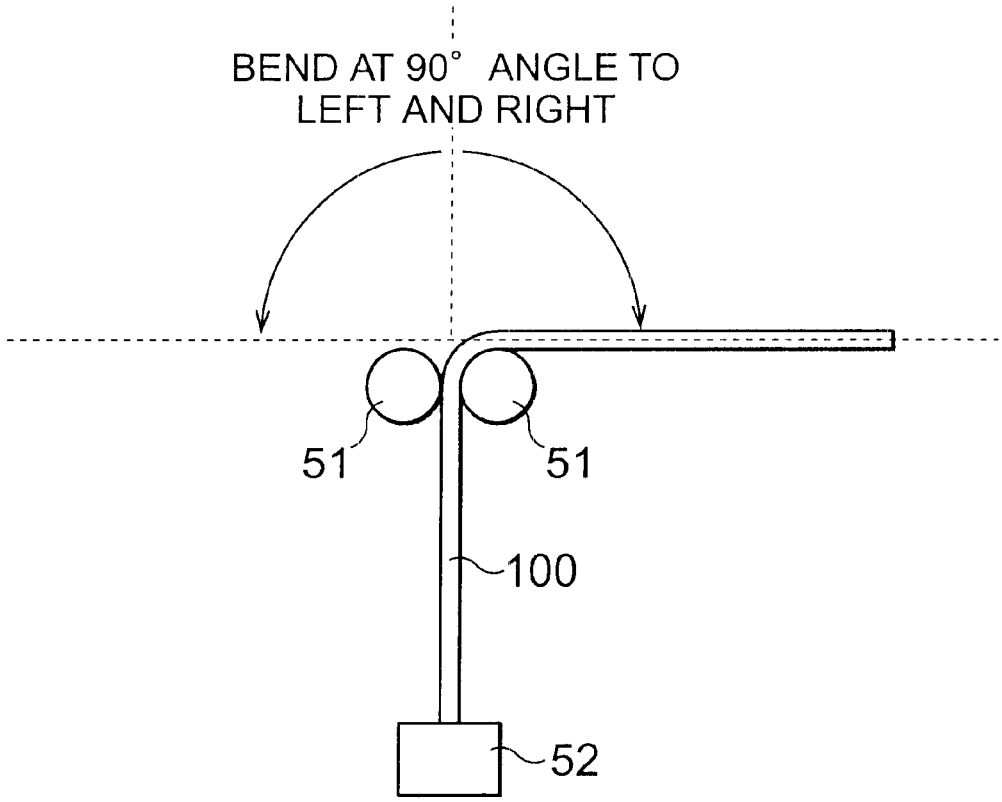
FIG. 5 is a diagrammatic view for explaining flexural testing methods employed in the present application.

FIG. 5 is a diagrammatic view for explaining a flexural test (so-called, a left-right swing test) employed in the present application. A test piece 100 corresponding to the core conductor was held at its mid portion between two metallic bars 51 (having an outer diameter of 2 mm) and a weight of 5 gr was attached to the lower end of the test piece 100. Then, the test piece 100 was bent so as to cause the upper half thereof to turn to the left or right at an angle of 90° about the bar 51. One cycle of bending comprises a 90° turn of the test piece 100 to either of the left and the right. The test piece was bent at a rate of 30 cycles per minute and the number of cycles at which the test piece was broken was measured.

Method of Flexural Testing 2

As a test piece 100, a multi-coaxial cable (i.e., a coaxial cable bundle) was provided. The outer diameter of the bar 51 was 25.4 mm and the weight 52 was 500 gr. With the remaining conditions being unchanged from those for the method of flexural testing 1, the method of flexural testing 2 was conducted for the following items:

(1) The number of cycles at which a core conductor or an outer conductor was broken; and (2) The presence or absence of dielectric breakdown after 300 thousands cycles of bending. An evaluation was made based on a value of current flowing between core and outer conductors of the test piece 100 when a DC voltage of 1,000 volts was applied thereacross.

Example 1

(1) Manufacturing of elementary coaxial cable wire: First, a metallic material comprising silver 5% in weight and the rest including copper and inevitable impurities was cast into an ingot. After being cold rolled, the ingot was heat treated and drawn into a linear workpiece having a diameter of 0.08 mm. The surface of the workpiece was plated with tin to obtain the core conductor.

Then, an insulating material consisting of polyethylene terephthalate was extruded onto the core conductor to form an insulator having an outer diameter of 0.23 mm. A tin-plated copper alloy wire having a diameter of 0.03 mm and a tensile strength of 55 kgf/mm$^2$ was spiral wound around the insulator to form the outer conductor. In this manner, the elementary coaxial cable wire was obtained. The measured results of the tensile strength and plastic elongation of the core conductor and the tensile strength of the outer conductor are shown in Table 1 as below.

(2) Manufacturing of coaxial cable: The elementary coaxial cable wire was sandwiched between straps made of polyvinyl chloride (PVC). A heater was turned on to cause the straps to be heated and deposited onto the whole surface of the elementary coaxial cable wire. Thus, the single-coaxial cable having an outer diameter of 0.33 mm was obtained.

(3) Manufacturing of multi-coaxial cable: 192 coaxial cables were bundled together with their longitudinal axes being directed in the same direction and were formed into a substantially cylindrical body. Tin-plated conductors of a small diameter were braided around the cylindrical body. Then, a substantially cylindrical sheath made of PVC was formed around the conductor braided body to obtain a coaxial cable bundle having an outer diameter of 8.2 mm. In this manner, the multi-coaxial cable was manufactured.

Example 2

A multi-coaxial cable was manufactured in the same manner as that used in Example 1, except that the core conductor was made of a metallic material comprising silver 3% in weight and the rest including copper and inevitable impurities and that the outer conductor was made of a tin-plated copper alloy wire having a tensile strength of 80 kgf/mm$^2$. The measured results of the tensile strength and plastic elongation of the core conductor and the tensile strength of the outer conductor are shown in Table 1 as below.

Comparative Example 1

A multi-coaxial cable was manufactured in the same manner as that used in Example 1, except that the core conductor was made of a stranded wire of a 0.09 mm diameter obtained by twisting tin-plated copper alloy wires together, each copper alloy wire having a tensile strength of 80 kgf/mm$^2$ and a diameter of 0.03 mm. The measured results of the tensile strength and plastic elongation of the core conductor and the tensile strength of the outer conductor are shown in Table 1 as below.

Comparative Example 2

A multi-coaxial cable was manufactured in the same manner as that used in Example 1, except that the core conductor was made of a single tin-plated copper wire of a 0.08 mm diameter obtained by using a copper wire rod defined in JIS C 3106. The measured results of the tensile strength and plastic elongation of the core conductor and the tensile strength of the outer conductor are shown in Table 1 as below.

Comparative Example 3

A multi-coaxial cable was manufactured in the same manner as that used in Example 2, except that the core conductor was made of a single tin-plated copper wire of a 0.08 mm diameter obtained by using a copper wire rod defined in JIS C 3106. The measured results of the tensile strength and plastic elongation of the core conductor and the tensile strength of the outer conductor are shown in Table 1 as below.

Bending Test 1

Bending tests have been conducted, according to the above-described method of flexural testing 1, on the test pieces, i.e., core conductors used in Examples 1 and 2 and Comparative Examples 1 to 3. As a result, it has been found that the core conductor according to the present invention used in Example 1 could withstand a number of bending cycles about 3~4 times larger than that in Comparative Example 1, about 10 or more times larger than those in Comparative Examples 2 and 3. Thus, the core conductor according to the present invention can exhibit a high cyclic bending resistance, resulting in increased bending life. This apparently means that the elementary coaxial cable wire, coaxial cable and coaxial cable bundle each employing the core conductor having the high cyclic bending resistance also can exhibit a cyclic bending resistance higher than that of the prior art core conductor made of the stranded wire.

Bending Test 2

Bending tests have been conducted, according to the above-described method of flexural testing 2, on the test pieces, multi-coaxial cables manufactured as in Examples 1 and 2 and Comparative Examples 1 to 3. The results are shown in Table 1. As can be understood from these results, with the multi-coaxial cables of Examples 1 and 2, no break occurred in their core conductors even after they were subjected to 600 and 300 or more thousands times of the bending cycles, respectively. Thus, it has been shown that the multi-coaxial cables of Examples 1 and 2 could exhibit a sufficient cyclic bending resistance equal to or higher than that of the multi-coaxial cable in Comparative Example 1, of which core conductor consists of a stranded wire.

On the other hand, the multi-coaxial cables in Comparative Examples 2 and 3, their core conductors consisting of a solid single wire, were broken when being subjected to 12 thousands times of the bending cycles. Thus, it has been shown that the multi-coaxial cables of Examples 1 and 2 could exhibit a cyclic bending resistance 20 or more times higher than that of the multi-coaxial cables in Comparative Examples 2 and 3. From the foregoing, it has been confirmed that the coaxial cable bundle according to the present invention has a sufficient bending resistance, even though each core conductor employs a solid single wire.

Terminal End Compression Test

The end of each elementary coaxial cable wire manufactured as in Example 1 and Comparative Example 1 was inserted between stamping die members and compressively deformed by the load added to the die members from the opposite directions. Before and after such a compressive deformation, the cross section of the core conductor forming each coaxial cable was observed under a microscope. As a result, it has been shown that all the core conductors had the cross section of a substantially perfect circle before the compressive deformation thereof. However, after the compressive deformation, the cross section of the core conductor used in Example 1 was of a rather flat oval figure and such a cross section could be obtained repeatedly. In contrast to Example 1, the core conductor comprising the stranded wire used in Comparative Example 1 varied in cross section whenever the compressive deformation thereof was performed. That is, thin wires twisted into the stranded wire were undone.

Then, each compressively deformed elementary coaxial cable wire was soldered to such a substrate as a circuit board. As a result, the elementary coaxial cable wire of Example 1, of which core conductor has been deformed into a uniform elliptic shape, was favorably attached at the flat surface portion thereof to the substrate. In contrast, it was difficult to conveniently connect the elementary coaxial cable wire of Comparative Example 1 to the substrate because of the presence of the undone thin wires. In order to connect the elementary coaxial cable wire to the substrate, it was necessary to preliminary apply solder to the free end of the elementary coaxial cable wire so that the undone thin wires are fixed together. Thus, the elementary coaxial cable wire according to the present invention is superior in point of ability of its free end to be processed or machined. That is, the elementary coaxial cable wire can be connected to the substrate very easily.

It is understood from the foregoing that the invention provides an elementary coaxial cable wire, a coaxial cable, and a coaxial cable bundle, each of which has a sufficient bending resistance, can prevent a break or a short circuit in the connection, and can achieve greater economy.

From the invention thus described, it will be obvious that the present invention may be varied in many ways. Such variations are not to be regarded as a departure from the spirit and scope of the invention, and all such modifications as would be obvious to one skilled in the art are intended for inclusion within the scope of the following claims.

TABLE 1

| | | Example 1 | Example 2 | Comparative Example 1 | Comparative Example 2 | Comparative Example 3 |
|---|---|---|---|---|---|---|
| Core Conductor | Construction | Solid single Wire | Solid single Wire | Stranded Wire | Solid single Wire | Solid single Wire |
| | Tensile Strength (kgf/mm$^2$) | 140 | 125 | 80 | 50 | 50 |
| | Plastic Elongation (%) | 0.3 | 0.6 | 0.8 | 0.9 | 0.9 |
| Outer Conductor | Tensiie Strength (kgf/mm$^2$) | 55 | 80 | 55 | 55 | 80 |
| Bending Test 1 | Bending Times until fracture | 4250<br>5400 | 3500<br>4400 | 1500<br>1150 | 350<br>400 | 350<br>400 |
| Bending Test 2 | Bending Times until fracture | over 600000 | over 300000 | over 300000 | 12000 | 12000 |
| | Breakdown Existence After 300000 Bending Times | No | No | No | Yes | Yes |
| Terminal End Compression Test | Processability of Terminal End | Good (uniform) | — | No Good (loosened) | — | — |
| | Connectivity to Substrate | Good | — | Need Pre-Soldering | — | — |

What is claimed is:

1. An elementary coaxial cable wire comprising a core conductor, an insulator surrounding the core conductor, and an outer conductor surrounding said insulator, wherein said core conductor is made of a metallic material including copper and silver so as to have a tensile strength of 120 kg/mm$^2$ or more and an electric conductivity of from 60 to 90% by IACS, and said core conductor has a plastic elongation of L in %, which meets the requirements expressed by the following equation (1):

$$0.2\% < L \leqq 2.0\% \quad (1).$$

2. An elementary coaxial cable wire according to claim 1, wherein said metallic material has a silver percentage content of 2 to 10% in weight.

3. An elementary coaxial cable wire according to claim 1, wherein tensile strengths Tc and Tg of said core and outer conductors respectively meet the requirements expressed by the following equation (2):

$$Tg \leqq Tc \leqq Tg \times 3 \quad (2).$$

4. An elementary coaxial cable wire according to claim 1, wherein said core conductor has a diameter of 0.010 to 0.2 mm.

5. A coaxial cable comprising an elementary coaxial cable wire according to claim 1, and a sheath surrounding said elementary coaxial cable wire.

6. A coaxial cable according to claim 5, wherein a plurality of said elementary coaxial cable wires are provided, and wherein said elementary coaxial cable wires are arranged in a row within said sheath.

7. A coaxial cable bundle comprising a plurality of coaxial cables according to claim 5, wherein said coaxial cables being disposed within a sheath.

* * * * *